US010995523B2

(12) United States Patent
Claeys et al.

(10) Patent No.: US 10,995,523 B2
(45) Date of Patent: May 4, 2021

(54) SECURITY TAG INCLUDING THERMALLY ACTUATED DETACHMENT MECHANISM

(71) Applicant: Sensormatic Electronics, LLC, Boca Raton, FL (US)

(72) Inventors: Patrick S. Claeys, Pembroke Pines, FL (US); Kelvin L. Hunter, Lake Worth, FL (US); Thomas P. Solaski, Boca Raton, FL (US); Sergio M. Perez, Lake Worth, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 0 days.

(21) Appl. No.: 16/816,030

(22) Filed: Mar. 11, 2020

(65) Prior Publication Data

US 2020/0291690 A1 Sep. 17, 2020

Related U.S. Application Data

(60) Provisional application No. 62/817,508, filed on Mar. 12, 2019.

(51) Int. Cl.
*E05B 73/00* (2006.01)
*E05B 47/00* (2006.01)

(52) U.S. Cl.
CPC ..... *E05B 73/0017* (2013.01); *E05B 47/0009* (2013.01)

(58) Field of Classification Search
CPC ..... E05B 73/0017; E05B 47/0009
See application file for complete search history.

(56) References Cited

U.S. PATENT DOCUMENTS 6,285,286 B1 * 9/2001 Tyren ..... E05B 73/0017 340/426.28
9,836,934 B2 * 12/2017 Joseph ..... G08B 13/2417
2004/0100385 A1 * 5/2004 Hansen ..... E05B 73/0052 340/572.9

(Continued)

FOREIGN PATENT DOCUMENTS

DE 20014860 U1 10/2000
EP 0947650 A1 10/1999
WO WO2010045398 A1 4/2010

OTHER PUBLICATIONS

International Search Report and Written Opinion for International Patent Application No. PCT/US2020/022434, dated Jun. 26, 2020.

*Primary Examiner* — Mohamed Barakat
(74) *Attorney, Agent, or Firm* — Arent Fox LLP

(57) ABSTRACT

A security tag includes a tag body member, a connecting member releasably engageable with the tag body member, and a locking member having a locked position in a first thermal state configured to lock the connecting member to the tag body member, and having an unlocked position in a second thermal state configured to unlock the connecting member from the tag body member. The locking member includes a locking body comprising a shape memory alloy, and a clamping member connected to the shape memory alloy. A transition of the shape memory alloy element from the first thermal state to the second thermal state moves the clamping member from the locked position to the unlocked position, thereby enabling the connecting member to be detached from the tag body member.

27 Claims, 8 Drawing Sheets

(56) References Cited

U.S. PATENT DOCUMENTS

| | | | | |
|---|---|---|---|---|
| 2010/0097223 | A1* | 4/2010 | Kruest | E05B 47/0011 340/572.1 |
| 2015/0082842 | A1* | 3/2015 | Appalucci | E05B 73/0017 70/19 |
| 2016/0027271 | A1 | 1/2016 | Paul et al. | |
| 2016/0321894 | A1 | 11/2016 | Schneider | |
| 2017/0004691 | A1* | 1/2017 | Alicot | G08B 13/2434 |

* cited by examiner

SECURITY TAG INCLUDING THERMALLY ACTUATED DETACHMENT MECHANISM

CLAIM OF PRIORITY

The present application claims priority to U.S. Application No. 62/817,508 filed on Mar. 12, 2019, which is incorporated by reference herein.

TECHNICAL FIELD

The present disclosure relates generally to a security tag attachable to an article for purposes of tracking and securing merchandise in a retail setting, and more particularly to a security tag including a thermally actuated detachment mechanism.

BACKGROUND

Security tags currently on the market use a traditional release mechanism—some form of imposed force at a point of concentration, where the imposed force is either mechanical or magnetic in nature, to cause detachment of the tag from the article being protected. These tag detachment systems tend to be slow, and also require user manipulation and handling to effect the desired tag detachment. Some solutions have been proposed which utilize detachers powered by motors, linear actuators, or magnetic solenoids, however, these arrangements are not considered a realistic marketplace solution due to cost and complexity.

Additionally, these traditional release mechanisms tend to be slow as the process requires user manipulation and handling.

SUMMARY

The present disclosure includes various mechanisms and methods that enable security tags to be self-detaching. As used herein, the term "self-detaching" means a security tag attached to an article which can be unlocked and detached without the use of a specialized detachment apparatus designed to impart an extreme mechanical or magnetic force on a portion the tag.

In an implementation, the security tags as described herein include a tag body, a connecting member releasably engageable with the tag body member, and a locking member having a locked position in a first thermal state configured to lock the connecting member to the tag body member, and having an unlocked position in a second thermal state configured to unlock the connecting member from the tag body member. The security tag includes a security device mounted in the tag body and configured to transmit a security device signal in response to receiving an interrogation signal, the security device signal including identification information. The locking member of the security tag includes a locking body having a shape memory alloy element. The locking member also includes a clamping member connected to the shape memory alloy element, such that the transition of the shape memory alloy element from the first thermal state to the second thermal state is configured to move the clamping member from the locked position to the unlocked position. The connecting member includes a pin member and the clamping member is configured to engage the pin member in the locked position. The security tag also includes a biasing member in contact with the locking member and having a biasing force configured to bias the locking member toward the locked position. The security tag also includes an energy harvesting device configured to releasably store energy and a circuit electrically connecting the energy harvesting device with the locking member. The shape memory alloy element of the locking member is connected to the circuit. A release of the energy from the energy harvesting device is configured to cause the shape memory alloy element to transition from the first thermal state to the second thermal state and to move the locking member from the locked position to the unlocked position.

In one implementation of the security tag, the connecting member includes a pin portion extending along a first axis, and the locking member includes a clamping member movable along a second axis normal to the first axis between a first position in contact with the pin portion and corresponding to the locked position and a second position corresponding to the unlocked position. The security tag also includes a shape memory alloy element connected to the clamping member and configured to move the clamping member to the second position to release the pin portion in response to the shape memory alloy element transitioning from the first thermal state to the second thermal state. The security tag also includes a biasing member in contact with the clamping member and having a biasing force along the second axis in a direction toward the pin portion to bias the clamping member into the locked position. The shape memory alloy is configured to transition from the first thermal state to the second thermal state in response to an increase in temperature, wherein a second length of the shape memory alloy in the second thermal state is smaller than a first length of the shape memory alloy in the first thermal state. The security tag also includes a circuit in electrical communication with the shape memory alloy element, the circuit configured to provide an electrical signal to the shape memory alloy element, in response to a release command, to trigger movement of the shape memory alloy element from the first thermal state to the second thermal state. The security tag also includes the electrical circuit configured to transmit the electrical signal, in response to the release command, to the shape memory alloy element to heat the shape memory alloy element, and contract the shape memory alloy element to move the clamping member to the second position.

In one implementation of the security tag, the connecting member includes a pin portion extending along a first axis, and the locking member includes a clutch mechanism movable along a second axis parallel to the first axis between a first position in contact with the pin portion and corresponding to the locked position and a second position corresponding to the unlocked position. The security tag includes a shape memory alloy element connected to the clutch mechanism and configured to move the clutch mechanism to the second position to release the pin portion in response to the shape memory alloy element transitioning from the first thermal state to the second thermal state. The security tag also includes a biasing member in contact with the clutch mechanism and having a biasing force in a direction along the second axis to bias the clutch mechanism into the locked position. The biasing member may be defined by the shape memory alloy element having a helical shape. The shape memory alloy element may comprise one or more shape memory alloy wires, a first end of each of the shape memory alloy wires connected to the clutch mechanism and a second end of each of the shape memory alloy wires connected to the tag body. The security tag also includes a circuit in electrical communication with the shape memory alloy element, the circuit configured to provide an electrical signal to the shape memory alloy element, in response to a release command, to trigger movement of the shape memory alloy element from the first thermal state to the second thermal state.

In one implementation of the security tag, the connecting member includes a pin portion extending along a first axis and the locking member includes a jaw mechanism movable in a plane that intersects the first axis between a first position in contact with the pin portion and corresponding to the locked position and a second position corresponding to the unlocked position. The security tag includes a shape memory alloy element connected to the jaw mechanism and configured to move the jaw mechanism within the plane to the second position to release the pin portion in response to the shape memory alloy element transitioning from the first thermal state to the second thermal state. The security tag also includes a fulcrum member extending from the tag body, the jaw mechanism including a first jaw member and a second jaw member each rotatably connected to the tag body. The shape memory alloy element including a longitudinal body in contact with the fulcrum member between a first end connected to the first jaw member and a second end connected to the second jaw member. The security tag also includes a biasing member in contact with the jaw mechanism and having a biasing force in a direction toward the jaw mechanism to bias the jaw mechanism into the locked position. The security tag also includes a circuit in electrical communication with the shape memory alloy element, and the circuit configured to provide an electrical signal to the shape memory alloy element, in response to a release command, to trigger movement of the shape memory alloy element from the first thermal state to the second thermal state.

In one implementation of the security tag, the connecting member includes a pin portion extending along a first axis. The locking member includes a jaw mechanism movable in a plane that intersects the first axis between a first position in contact with the pin portion and corresponding to the locked position and a second position corresponding to the unlocked position. The security tag includes a wedge member movable into contact with the jaw mechanism, and a shape memory alloy element connected to the wedge member and configured to move the wedge member to slidingly force the jaw member into the second position in response to the shape memory alloy element transitioning from the first thermal state to the second thermal state. The security tag also includes a fulcrum member extending from the wedge member, the jaw mechanism including a first jaw member and a second jaw member each rotatably connected to the tag body. The shape memory alloy element includes a longitudinal body in contact with the fulcrum member between a first end connected to the first jaw member and a second end connected to the second jaw member. The security tag includes a biasing member in contact with the jaw mechanism having a biasing force in a direction toward the jaw mechanism to bias the jaw mechanism into the locked position. The security tag also includes a circuit in electrical communication with the shape memory alloy element, and the circuit configured to provide an electrical signal to the shape memory alloy element, in response to a release command, to trigger movement of the shape memory alloy element from the first thermal state to the second thermal state.

Another implementation of the present disclosure includes a method to enable security tags to be self-detaching, including disposing a locking member disposed in the tag body member, the locking member including at least one clamp for holding a portion of the pin portion in a locked position. The method includes attaching at least one segment of shape memory alloy (SMA) wire to a portion of the locking member such that the SMA wire is operatively associated with the at least one clamp, and positioning and configuring the SMA wire within the tag body such that heat-induced shrinkage of the SMA wire serves to mechanically urge the clamp to an unlocked, pin-releasing position. The method also includes heating the SMA by application of an electrical current until the SMA retracts to a smaller size relative to the original unheated size of the SMA, the reduction in size of the SMA causing the one or more clamps to be moved to an unlocking position by a mechanical linkage between the one or more clamps and the SMA whereby the pin portion is released from the clamp, and withdrawing the pin portion from the tag body member to release an article secured between the pin portion and the tag body member. The method further includes inducing an electrical current in one or more elements in the tag body member using an applied field, harvesting the energy produced by the induced current, and storing the harvested energy in an energy storage module disposed in the tag body member. The method further includes providing an electronic trigger signal to selectively release energy stored in the energy storage module at such time when the release of the pin portion from the one or more clamps is desired.

In one or more implementations, the present method and apparatus utilizes a Shape Memory Alloy ("SMA") wire, which can serve as a thermally actuated "motor" by virtue of heat-induced changes in shape to provide mechanical action to cause the release of a pin portion of a security tag from a locking member of the tag, thus providing a self-detaching security tag.

DETAILED DESCRIPTION

Currently available security tags have been found to be a hindrance to store checkout throughput, and further cause a deterioration in the distribution center efficiency due to their very manual nature. In the security tags of the present disclosure, an unlocking force with the source of the input force being a thermally-actuated motor, such as shape memory alloy member, can be used to detach the security tags. A self-detaching tag as proposed herein can be efficiently and easily operated, relative to existing security tags, by simplifying the detaching methods.

Figure 1:
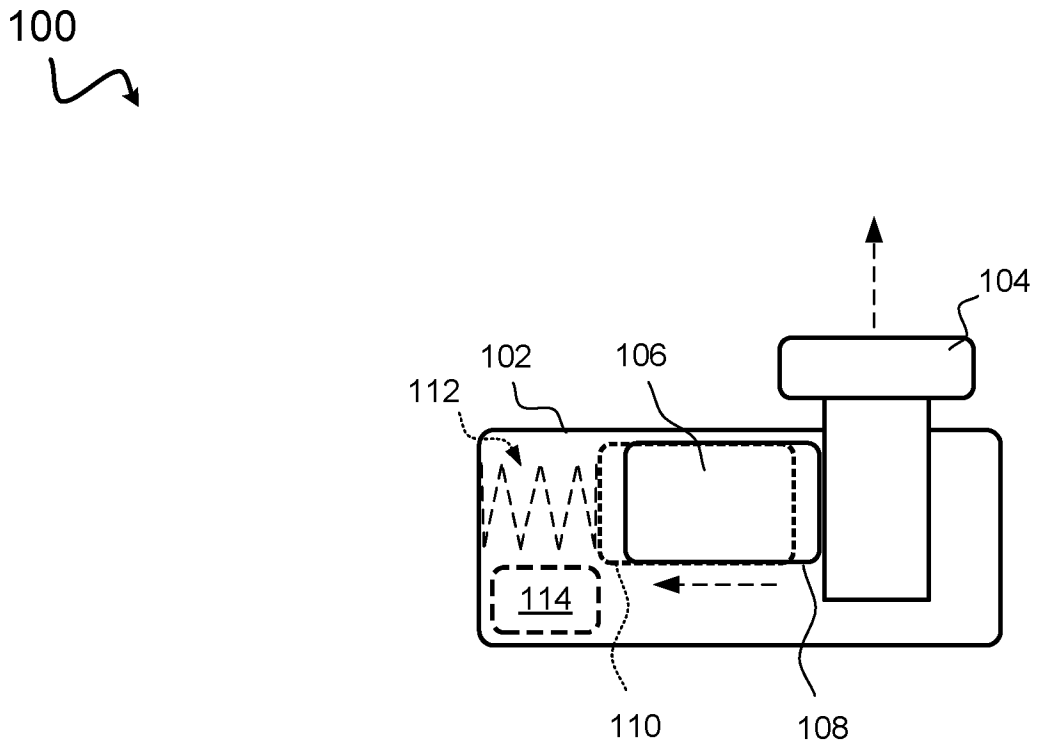
FIG. 1 is a block diagram of a security tag according to the present disclosure.

Referring to FIG. 1, a security tag 100 has a tag body member 102 configured to releasably hold a connecting member 104 based on a thermal change of state associated with a locking member 106. The connecting member 104, which in an implementation may include a pin member, is engaged with the tag body member 102 (e.g., gripped by the tag body member 102) when the security tag 100 and/or locking member 106 is in a locked state, and the pin member is released from the tag body member 102 when the security tag 100 and/or locking member 106 is in the unlocked state. Specifically, the locking member 106 may include a locking body formed from or including a shape memory alloy element (as described below with reference to FIGS. 2-13). The locking member 106 may be movable between a locked position 108 (corresponding to the locked state of the security tag 100) and an unlocked position 110 (corresponding to the unlocked state of the security tag 100) based on the locking member 106 or shape memory alloy element thereof transitioning from a first thermal state to a second thermal state. For example, a temperature of the first thermal state is less than a temperature of the second thermal state. In an implementation, the locking member 106 may further include an electronic circuit configured to provide an electrical signal to a shape member alloy (SMA) element to transition the shape memory alloy element from the first thermal state corresponding to the locked position 108 to the second thermal state corresponding to the unlocked position 110. For instance, in the unlocked state of the security tag 100, e.g., with the locking member 106 in the unlocked position 110, the connecting member 104 may be moved away from the security tag body member 102, as indicated by the arrow. For example, moving the locking member 106 to the unlocked position 110 enables the connecting member 104 to disengage from the tag body member 102, which allows the security tag 100 to be removed from an article or merchandise pinned between the connecting member 104 and the tag body member 102. In an implementation, the tag body member 102, the connecting member 104, and the locking member 106 may be made of a plastic, a metal, and/or a composite material.

Optionally, as indicated by dashed lines, the security tag 100 may include a biasing member 112 in contact with the locking member 106 and having a biasing force configured to bias the locking member 106 toward the locked position 108. For example, in an aspect, the biasing member 112 may include an elastic element, a spring, rubber, or any other mechanism capable of applying a biasing force to the locking member 106 to move the locking member 106 toward the locked position 108.

Further, the security tag 100 may include a security device 114 mounted in the tag body member 102 and configured to operate in an electronic article surveillance (EAS) system to track articles or merchandise to which the security tag 100 is attached. The security device 114 may include, but is not limited to, an acousto-magnetic (AM) tag (e.g., a strip of magnetostrictive, ferromagnetic amorphous metal and a strip of a magnetically semi-hard metallic strip, which is used as a biasing magnet (to increase signal strength) and to allow deactivation), a Radio Frequency Identification (RFID) tag, or a dual tech tag based on a combination of technologies. The security device 114 may include at least one transmitter and at least one receiver, e.g., an AM tag element, an RFID transmitter and an RFID receiver, or both. The security device 114 may further contain a specific serial number for each specific object (e.g., an electronic product code (EPC)). For example, in one implementation, the security device 114 may include multiple memory banks such as a reserved memory, an EPC memory, a tag identification (TID) memory, and a user memory. The reserved memory bank may include an access password and a kill password. The EPC memory may include the EPC, a protocol control, and a cyclic redundancy check value. The TID memory may include a tag identification. The user memory may store custom data. In an aspect, the security device 114 may be in communication with the locking member 106 and may be configured to trigger the locking member 106 to transition from the locked position 108 to the unlocked position 110.

To read the information encoded on the security device 114 of the security tag 100, a two-way radio transmitter-receiver called an interrogator (e.g., a checkout system at a point of sales terminal (POS)) may emit a signal to the security tag 100 using one or more antennas, antenna panels or antenna arrays (e.g., internal antennas). For example, the security tag 100 may receive an interrogation signal from the interrogator requesting for identification information of the security tag 100. The security tag 100 may transmit a security device signal including identification information in response to the interrogation signal. For example, the security device signal may include the EPC. Upon receiving the security device signal, the interrogator may determine whether the product corresponding to the EPC has been paid for. The interrogator may then transmit one or more instructions to the security tag 100. For example, on determining that the product has been paid for, the interrogator may send a signal to the security tag 100 to change the security tag 100, and specifically the locking member 106, from the locked state/locked position 108 to the unlocked state/unlocked position 110.

Further details and different implementations of the security tag 100 are described below with reference to FIGS. 2-13.

Figure 2:
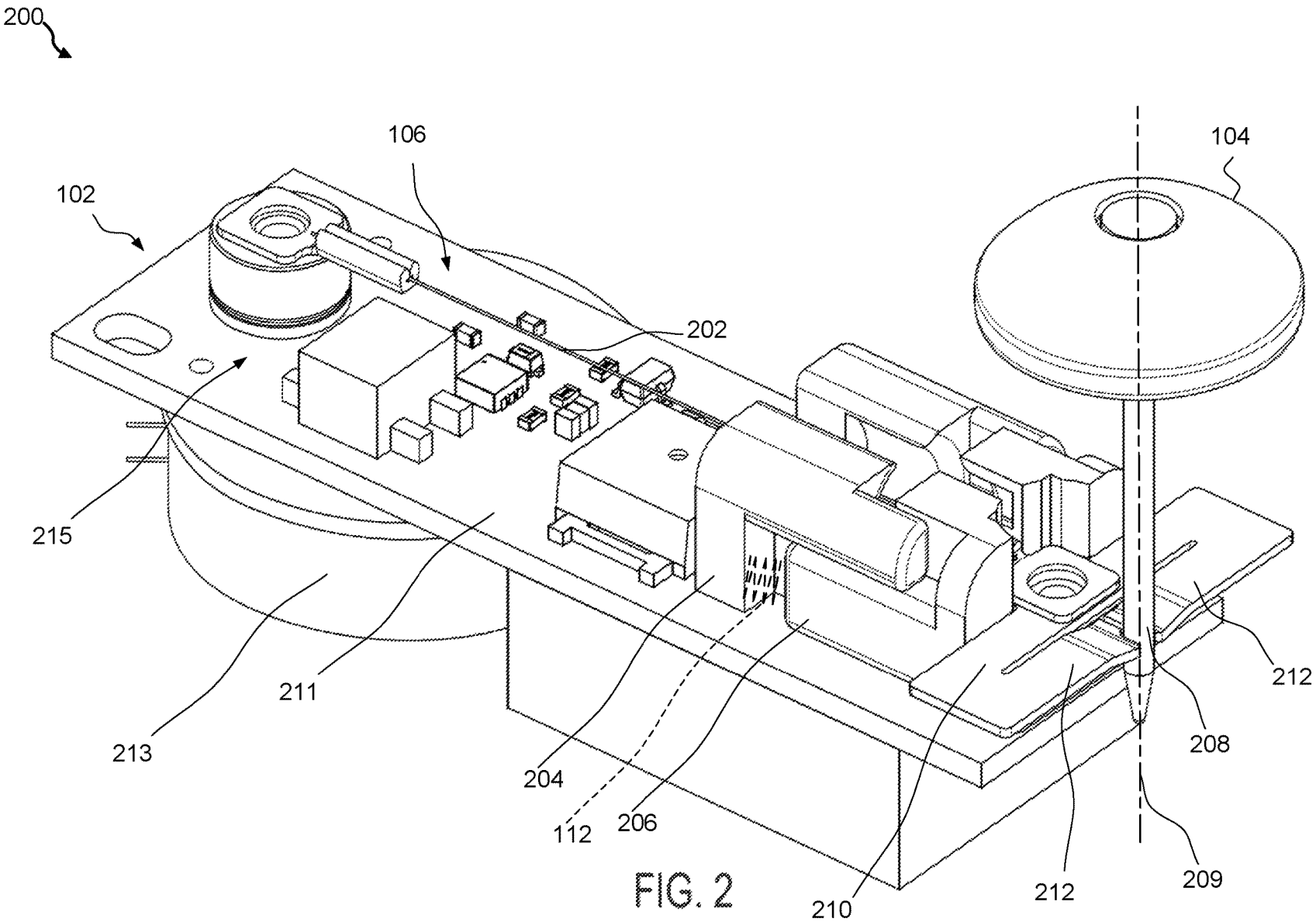
FIG. 2 is a front perspective view, with the security tag body removed, of internal components of a linear clamp implementation of the security tag in a locked state.
Figure 3:
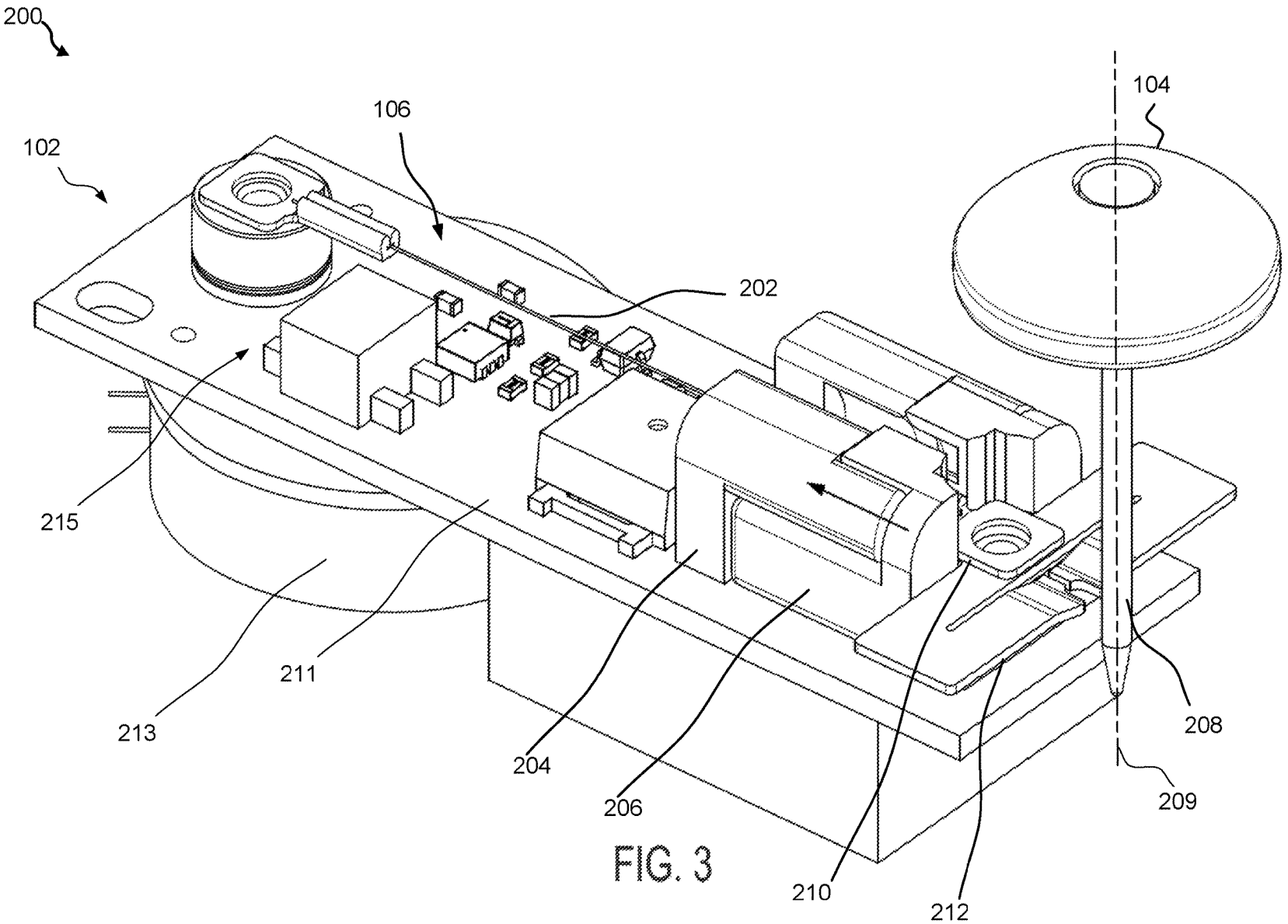
FIG. 3 is a front perspective view, with the security tag body removed, of the linear clamp implementation of the security tag of FIG. 2 in an unlocked state, with the arrow indicating a direction of movement of the locking mechanism components.

Referring to FIGS. 2 and 3, a linear clamp implementation 200 of a security tag (e.g., the security tag 100 as described above with reference to FIG. 1) may be moved between a locked state (FIG. 2) and an unlocked state (FIG. 3). The linear clamp implementation 200 includes the locking member 106, the connecting member 104, and the tag body member 102 (not shown, for clarity) as described above with reference to FIG. 1. The connecting member 104 includes a pin portion 208 extending along a first axis 209 (vertical as shown in FIG. 2).

The locking member 106 includes a clamping member 210 movable between a locked position (FIG. 2) and an unlocked position (FIG. 3) by an SMA wire 202. In an implementation, one end of the SMA wire 202 is connected to the clamping member 210 and the other end is connected to a mount on the tag body member 102 or a component mounted within the tag body member 102 (such as a circuit board 211 in this example). The SMA wire 202 can be a nickel-titanium alloy such as that sold under the brand name "Nitinol". Nitinol is a trade name adapted in part from the elements it is composed of—nickel (Ni) and titanium (Ti). Nitinol SMA is distinguishable from other materials by its shape memory and super elastic characteristics.

The clamping member 210 is movable along a second axis (horizontal as shown in FIG. 2) normal to the first axis 209 between a first position in contact with the pin portion 208 and corresponding to the locked position (as shown in FIG. 2) and a second position corresponding to the unlocked position (as shown in FIG. 3). In an implementation, the clamping member 210 includes an elongated body having one or more grooves that define retaining tabs 212 to capture the pin portion 208 of the connecting member 104 in the locked position and prevent the release of the pin portion 208 from the clamping member 210.

The locking member 106 may also include a guiding member 204 that limits movement of a sled 206 that is in contact with the clamping member 210. Optionally, the tag body member 102 may include the biasing member 112 to provide a biasing force between the guiding member 204 and the sled 206 to move the sled 206 toward the locked position. The biasing member 112 provides a biasing force along the second axis in a direction toward the pin portion 208 to bias the clamping member 210 into the locked position.

For example, in this linear clamp implementation 200 of a security tag, the SMA wire 202 is connected at one end of a fixed mount and to the clamping member 210 at the other end. Further, the SMA wire 202 is held at a slightly extended length in a first thermal state by the guiding member 204 limiting movement of the sled 206, which may also be biased toward the first axis 209 by the biasing member 112. When triggered to transition to the second thermal state, the SMA wire 202 contracts to overcome any biasing force and move the clamping member 210 to the unlocked position (FIG. 3). In other words, the linear clamp implementation 200 utilizes a linear force exerted on the clamping member 210 so that the clamping member 210 is pushed in the direction of the pin portion 208 by the biasing force in the locked position and pulled in a direction away from the pin portion 208 in the unlocked position (as described below in FIG. 3).

In some implementations, the linear clamp implementation 200 (or any other implementation discussed herein) of the security tag 100 may include an energy harvesting device 213 for releasably storing energy to trigger the locking member 106, and/or the SMA wire 202, to transition from the first thermal state/locked position to the second thermal state/unlocked position. For example, the energy harvesting device 213 may enable the security tag 100 to derive power through inductive charging. The energy may be stored in an energy storage module which is also disposed within the security tag 100. The security tag 100 can include an electrical trigger to release the stored energy at a proper voltage. An RFID inlay in the security tag 100 may provide an output for additional security to selectively allow an actuator system to be activated once the tag has been verified. The security tag 100 may also include a circuit 215 electrically connecting the energy harvesting device 213 with the locking member 106 and/or SMA wire 202. The shape memory alloy element, e.g., the SMA wire 202, of the locking member 106 may be connected to the circuit 215 such that a release of the energy from the energy harvesting device 213 causes the shape memory alloy element (SMA wire 202) to transition from the first thermal state to the second thermal state. For example, the shape memory alloy element (SMA wire 202) may be at a lower temperature (than the temperature in the second thermal state) in the first thermal state and at a higher temperature (than the temperature in the first thermal state) in the second thermal state. The shape memory alloy element (SMA wire 202) may change in size upon transition from the first thermal state to the second thermal state. For example, the shape memory alloy element (SMA wire 202) may transition from a first length in the first thermal state to a second length in the second thermal state, such that the second length is smaller than the first length. The transition of the shape memory alloy from the first thermal state to the second thermal state may move the locking member 106 from the locked position to the unlocked position. For example, in the linear clamp implementation 200, the locking member 106 may include the clamping member 210 connected to the SMA wire 202 such that a transition of the SMA wire 202 from the first thermal state to the second thermal state moves the clamping member 210 from the locked position (FIG. 2) to the unlocked position (FIG. 3).

Referring specifically to FIG. 3, the linear clamp implementation 200 (as described above with reference to FIG. 2) of the security tag is moved from the locked state to the unlocked state. For example, upon receiving an instruction from the interrogator (as described above in FIG. 1), the energy harvesting device 213 on the security tag may release energy to the SMA wire 202 and cause the SMA wire 202 to transition from the first thermal state to the second thermal state, thereby contracting and causing the clamping member 210 to move away from the first axis 209 (as indicated by the arrow). In one implementation, the tag body member 102 may include the circuit 215 in electrical communication with the SMA wire 202. The circuit 215 may provide an electrical signal to the SMA wire 202, in response to a release command (e.g., the instruction received from the interrogator), to trigger transition of the SMA wire 202 from the first thermal state to the second thermal state. For example, the electrical signal may heat the SMA wire 202 causing the SMA wire 202 to contract, and the SMA wire 202 on contraction can move the clamping member 210 to a second position (as indicated along the direction of the arrow along the second axis in FIG. 3). The second position of the clamping member 210 may correspond to the unlocked position of the locking member 106. The movement of the clamping member 210 in the direction of the arrow results in a release of the pin portion 208, resulting in the unlocked state of the security tag. The clamping member 210 may cause the sled 206 to move in the direction of the arrow, and the guide member 204 may restrict the movement of the sled 206 along an axis normal to the first axis 209 and also to limit how far the clamping member 210 moves when the SMA wire 202 is in the second thermal state, such that the movement of the sled 206 does not interfere with operation of one or more components of the tag body member 102.

Figure 5:
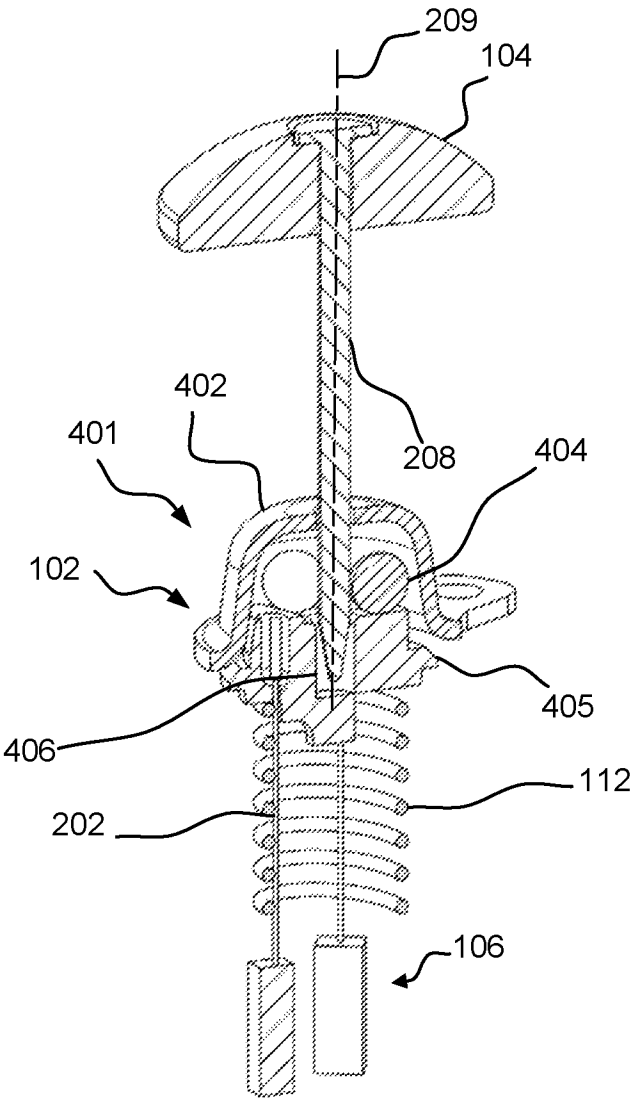
FIG. 5 is a cross-sectional view of the clutch system implementation of the security tag of FIG. 4.
Figure 4:
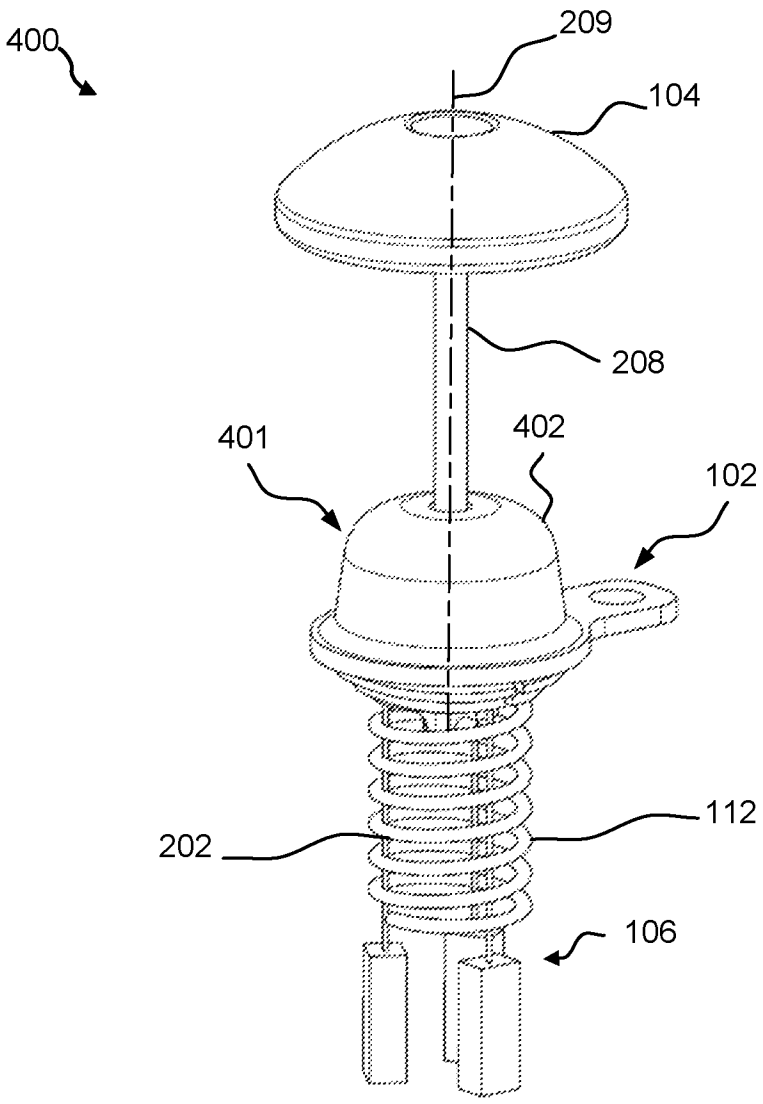
FIG. 4 is a front perspective view, with a bottom portion of the security tag body removed, of a clutch system implementation of the security tag in a locked state.
Figure 7:
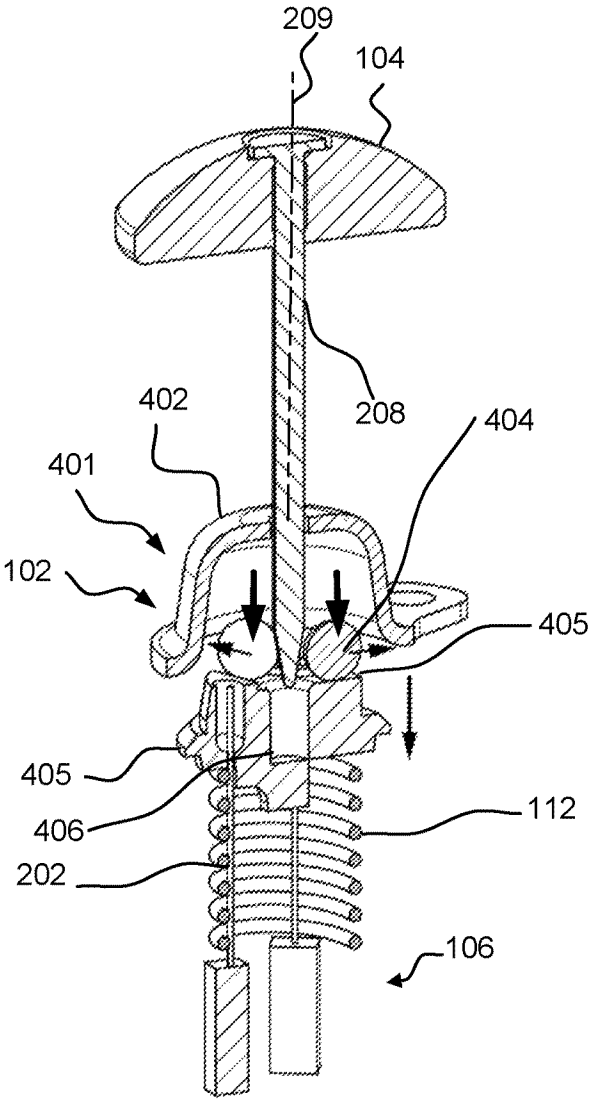
FIG. 7 is a cross-section view of the clutch system implementation of the security tag of FIG. 6, with the arrows indicating a direction of movement of the components.
Figure 6:
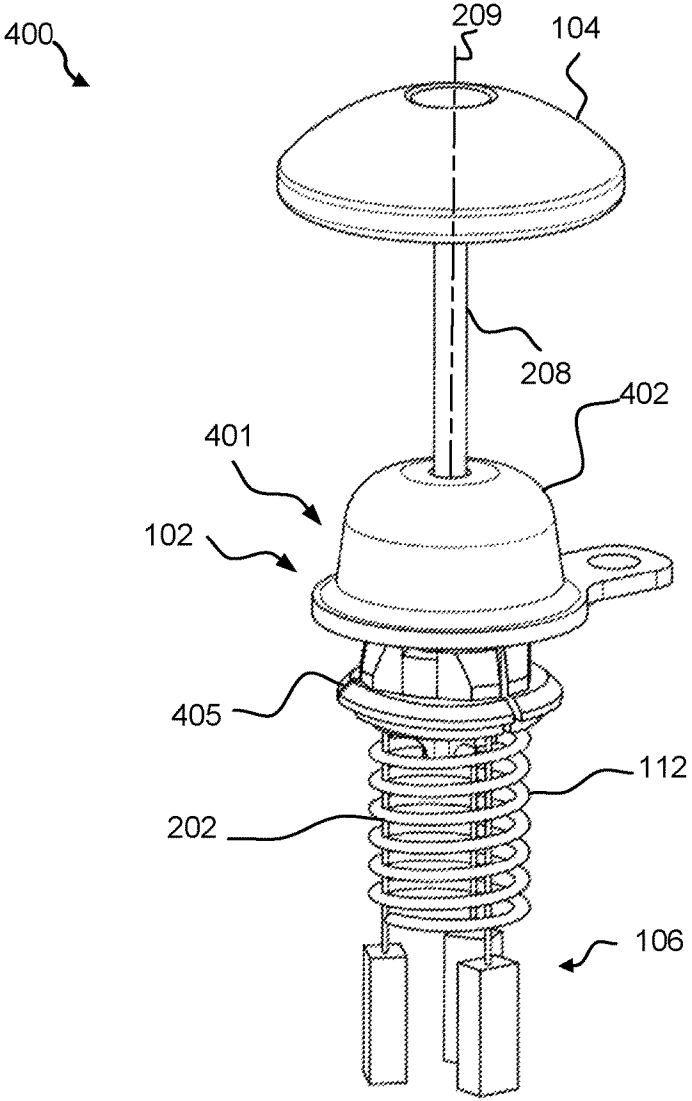
FIG. 6 is a front perspective view, with a bottom portion of the security tag body removed, of the clutch system implementation of the security tag of FIG. 4 in an unlocked state.

Referring to FIGS. 4-7, a clutch system implementation 400 of the security tag (e.g., the security tag 100 as described above with reference to FIG. 1) utilizes a clutch mechanism 401 moved parallel to the first axis 209 by one or more SMA wires 202 to move the tag from the locked state (FIGS. 4 and 5) to the unlocked state (FIGS. 6 and 7). The clutch system implementation 400 includes the connecting member 104 having the pin portion 208 (similar to the pin portion as described above with reference to FIG. 2) extending along the first axis 209 (vertical as shown in FIG. 4). The locking member 106 of the clutch system implementation 400 includes a housing 402 that forms a portions of the clutch mechanism 401 (as described below with reference to FIG. 5 that interacts with the one or more SMA wires 202. In the locked state of the security tag, the one or more SMA wires 202 are in the first thermal state, and the clutch mechanism 401 is in a first position in contact with the pin portion 208 and corresponding to the locked position of the locking member 106. The pin portion 208 of the connecting member 104 is captured by one or more components of the clutch mechanism 401 (as described below with reference to FIG. 5). In the unlocked state of the security tag, the one or more SMA wires 202 are in the second thermal state, and the clutch mechanism 401 is moved in a direction parallel to the first axis 209 to release the pin portion 208 (as described below with reference to FIG. 7).

Referring specifically to FIGS. 5 and 7, the housing 402 includes one or more clutch mechanism members 404 movable along a second axis (vertically down as shown in FIGS. 5 and 7) parallel to the first axis 209 between the first position (FIG. 5) in contact with the pin portion 208 and corresponding to the locked position of the locking member 106, and a second position (FIG. 7) corresponding to the unlocked position of the locking member 106. As the one or more clutch mechanism members 404 move vertically down, they may also move laterally out or normal to the first axis 209 to release the contact with the pin portion 208. The one or more clutch mechanism members 404 may include, but are not limited to, one or more balls configured to releasably hold the pin portion 208 of the connecting member 104. For example, the one or more clutch mechanism members 404 may include a three-ball clutch system with the three balls arranged within the housing 402, such that each of the three balls is in contact with the other two balls, and the three-ball arrangement forming a central vertical cavity there between to receive the pin portion 208. The clutch mechanism 401 as described in FIG. 4 is not limited to using balls, but could utilize other shaped structures (e.g., oval) such that the arrangement forms a cavity to receive the pin portion 208 and that is movable between positions that fixedly hold and that release the pin portion 208. Further, the number of balls or similar structures is not limited to three, and the number may be smaller or greater than three based on the design characteristics of the security tag (e.g., the size of the tag, the weight of the item to which a tag is to be attached, etc.).

The locking mechanism 106 of this implementation may further include a containing member 405 that holds the one or more clutch mechanism members 404 within the housing 402. The containing member 405 includes a body that may be supported by a biasing member 112 that exerts a biasing force on the one or more clutch mechanism members 404 to keep the pin portion 208 in place when the security tag is in the locked state. The containing member 405 may include an internal wall 406 that defines an opening to receive the pin portion 208 in the locked state of the one or more clutch mechanism members 404. As such, in this implementation, clutch mechanism 401 includes a combination of the housing 402, the one or more clutch mechanism members 404, and the containing member 405. The containing member 405 may be connected to the one or more SMA wires 202, which when transitioned to the second thermal state contract with sufficient force to overcome the biasing force provided by the biasing member 112, which thereby allows the one or more clutch mechanism members 404 to release the pin portion 208 and move from the locked position to the unlocked position.

In one implementation, the one or more SMA wires 202 may be a set of one or more straight SMA wires such that a first end of the SMA wires is connected to the clutch mechanism 401 and a second end of each wire is connected to a fixed mount, such as one or more components of the tag body member 102. More than one SMA wire 202 may be utilized in order to evenly apply force to the containing member 405. Alternatively, the one or more SMA wires 202 may be omitted, and the biasing member 112 may be formed of a helically wound SMA wire to provide the biasing force to the clutch mechanism 401 in the first thermal state and to contract and allow the clutch mechanism 401 to release in the second thermal state. The design of the SMA wire being helical or straight may depend on the design characteristics of the security tag (e.g., the size of the tag, the weight of the item to which a tag is to be attached, etc.).

Referring specifically to FIG. 7, the security tag may be moved from the locked state to the unlocked state, for example, upon receiving an instruction from the interrogator (as described above). For instance, the energy harvesting device 213 (FIG. 2) on the security tag may release energy to the SMA wire 202 and cause the SMA wire 202 to transition from the first thermal state to the second thermal state. In one implementation, the tag body member 102 may include a circuit 215 (FIG. 2) in electrical communication with the SMA wire 202. The circuit 215 may provide an electrical signal to the SMA wire 202, in response to a release command (e.g., the instruction received from the interrogator), to trigger transition of the SMA wire 202 from the first thermal state to the second thermal state. For example, the electrical signal may heat the SMA wire 202 causing the SMA wire 202 to contract, and the SMA wire 202 on contraction can cause the containing member 405 to move in a direction along the second axis (as shown by the down arrow in FIG. 7). The movement of the containing member 405 reduces the biasing force on the one or more clutch mechanism members 404, allowing the one or more clutch mechanism members 404 to move vertically down in a direction parallel to the first axis 209 and also laterally away from or normal to the first axis 209 (as shown by arrows pointing down and away from the first axis 209 in FIG. 7). Consequently, the clutch mechanism 401 moves into the second position and releases the pin portion 208 from the locking member 106. The second position of the clutch mechanism 401 may correspond to the unlocked position of the locking member 106. The movement of the clutch mechanism 401 results in a release of the pin portion 208, resulting in the unlocked state of the security tag.

Figure 9:
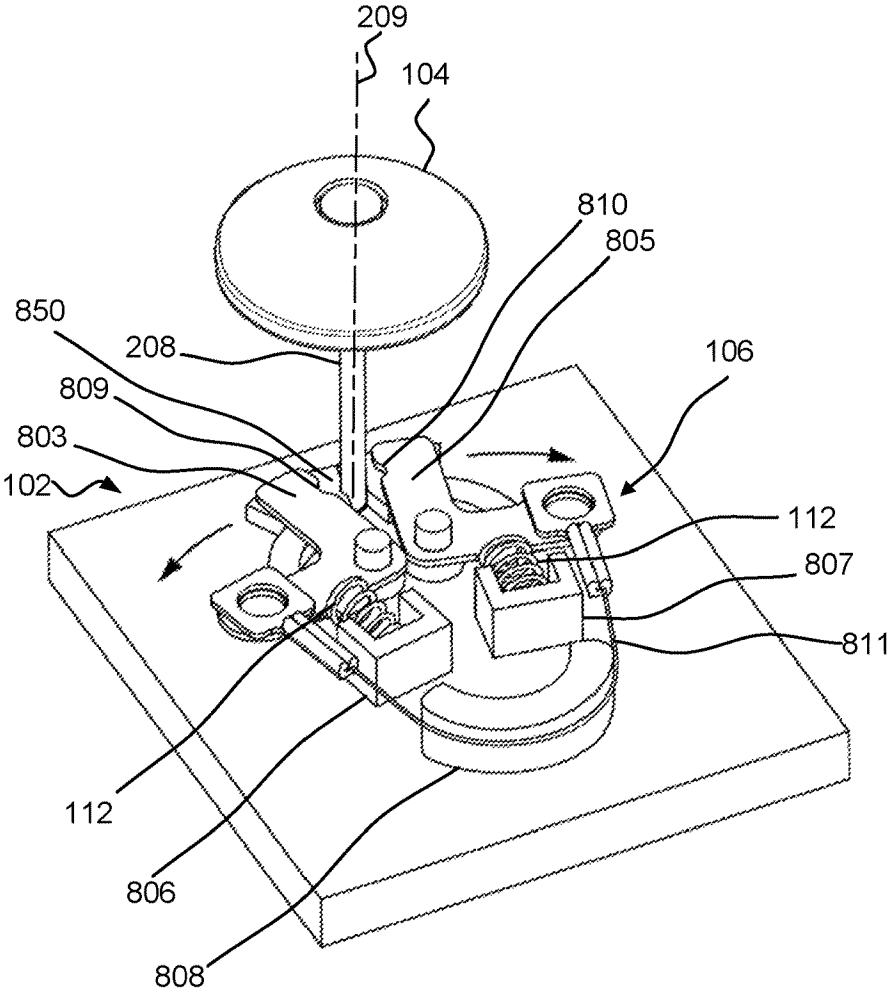
FIG. 9 is a front perspective view, with the security tag body removed, of the split-pivot jaws implementation of the security tag of FIG. 8 in an unlocked state, with the arrows indicating a direction of movement of the components.
Figure 8:
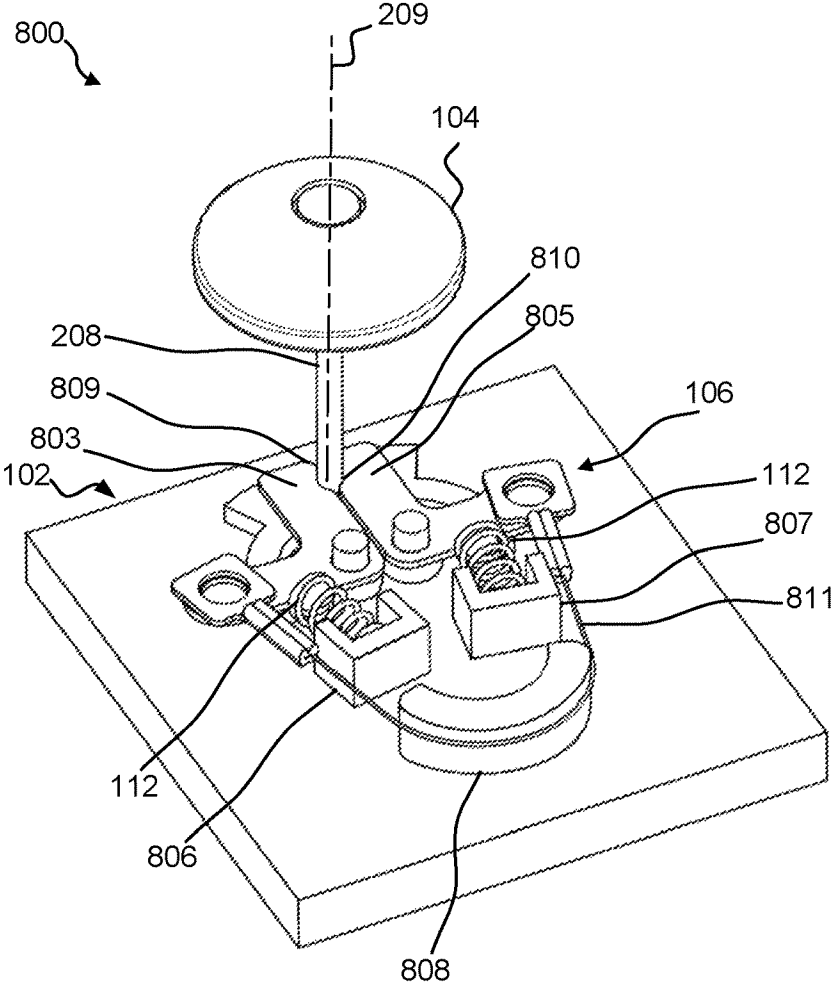
FIG. 8 is a front perspective view, with the security tag body removed, of a split-pivot jaws implementation of the security tag in a locked state.
Figure 11:
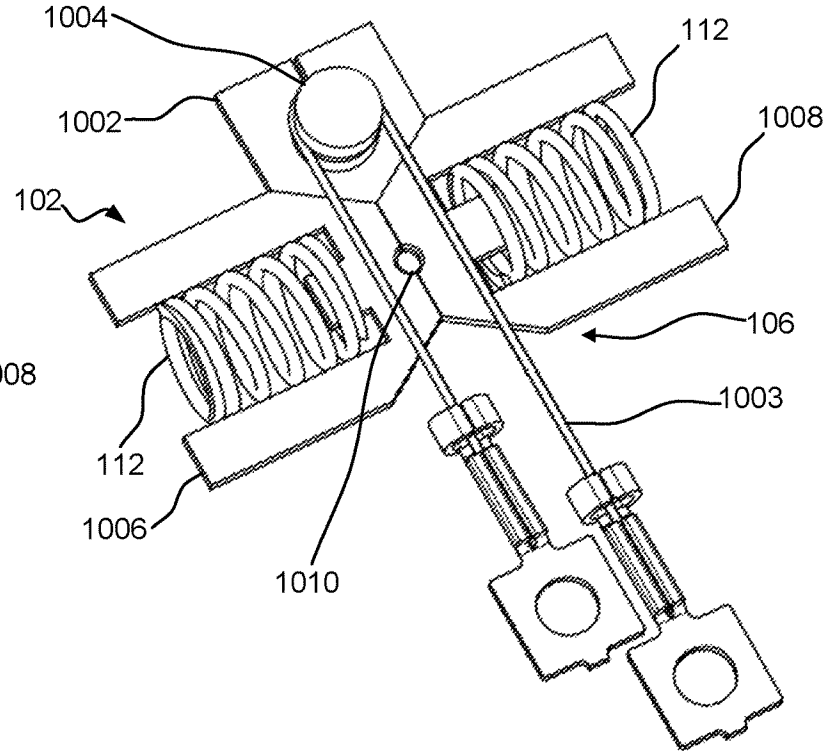
FIG. 11 is a top perspective view of the split wedge jaws components of the security tag of FIG. 10.

Referring to FIGS. 8 and 9, a split-pivot jaws implementation 800 of the security tag (e.g., the security tag 100 as described above with reference to FIG. 1) includes pivoting jaws that move in a plane that intersects the first axis 209 to releasably hold the connecting member 104 the security tag body member 102. The split-pivot jaws implementation 800 includes the connecting member 104 having the pin portion 208 (as described above with reference to FIG. 2) extending along the first axis 209 (vertical as shown in FIG. 8). The locking member 106 includes an SMA wire 811 (similar to the SMA wire 202 as described above with reference to FIG. 2). The SMA wire 811 may be bent around a fulcrum member 808 with the fulcrum member 808 extending from the tag body member 102, and a central portion of the SMA wire 811 held taut against the fulcrum member 808. A first end of the SMA wire 811 may be connected to a first jaw member 803 and the second end of the SMA wire 811 may be connected to the second jaw member 805. The first jaw member 803 and the second jaw member 805 are rotatably connected to the tag body member 102 and together form a jaws mechanism that have opposing edges 809 and 810 that define an opening 850 (as shown in FIG. 9) to receive and releasably hold the pin portion 208 of the connecting member 104.

The first jaw member 803 and the second jaw member 805 are movable in a plane that intersects the first axis 209 between a first position in contact with the pin portion 208 and corresponding to a locked position of the locking member 106 (FIG. 8) and a second position corresponding to the unlocked position in which the pin portion 208 is released from the opening 850 (FIG. 9). The SMA wire 811 can move the first jaw member 803 and the second jaw member 805 within the plane to the second position to release the pin portion 208 in response to a transition of the SMA wire 811 from the first thermal state to the second thermal state.

Additionally, in this implementation, the tag body member 102 may include a first mount member 806 and a second mount member 807 extending from the tag body member 102 to contain respective biasing members 112 configured to apply the biasing force to the jaw members 803 and 805 to bias them into the locked position. For example, the biasing force is provided along a second axis normal to the first axis 209 and in a direction toward the jaw members 803 and 805 to bias the jaw members 803 and 805 into the locked position. In the locked position of the locking member 106, the pin portion 208 is captured between the symmetrically-arranged pivoting clamp jaws (i.e., the first jaw member 803 and the second jaw member 805), and the security tag is in the locked state.

Referring specifically to FIG. 9, for example, upon receiving an instruction from the interrogator (as described above), the energy harvesting device 213 (FIG. 2) on the security tag may release energy to the SMA wire 811 and cause the SMA wire 811 to transition from the first thermal state to the second thermal state. In one implementation, the tag body member 102 may include the circuit 215 (FIG. 2) in electrical communication with the SMA wire 811. The circuit 215 may provide an electrical signal to the SMA wire 811, in response to a release command (e.g., the instruction received from the interrogator), to trigger transition of the SMA wire 811 from the first thermal state to the second thermal state. For example, the electrical signal may heat the SMA wire 811 causing the SMA wire 811 to contract, and the SMA wire 811 on contraction can move the jaw mechanism to the second position. For example, the SMA wire 811 may move the first jaw member 803 and the second jaw member 805 within a plane along the second axis and in a direction opposite to the pin portion 208 (as indicated along the direction of the arrow along the second axis in FIG. 9). The second position of the jaw mechanism may correspond to the unlocked position of the locking member 106. The movement of the first jaw member 803 and the second jaw member 805 in the direction of the arrow (as shown in FIG. 9) causes a release of the pin portion 208 from the opening 850, resulting in the unlocked state of the security tag.

Figure 10:
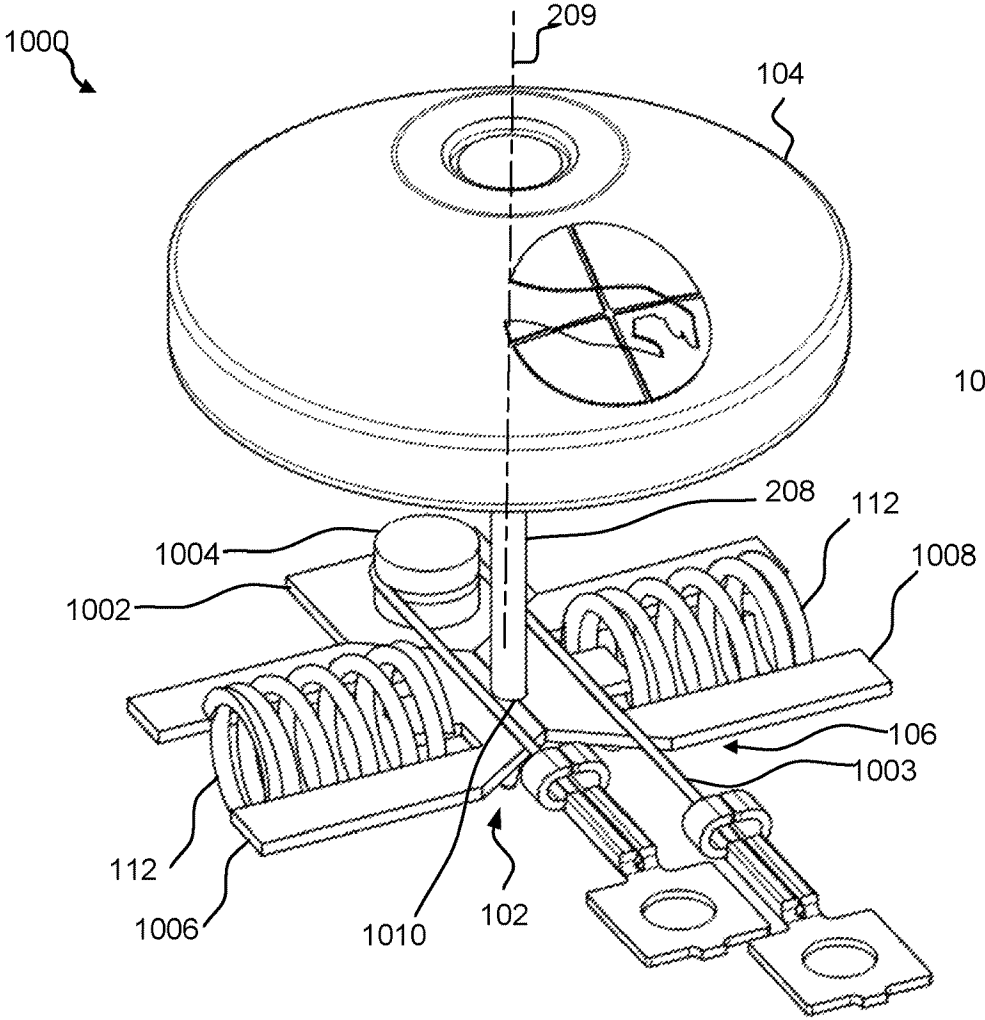
FIG. 10 is a front perspective view, with the security tag body removed, of a split wedge jaws implementation of the security tag in a locked state.

Referring to FIGS. 10-13, a split wedge jaws implementation 1000 (e.g., the security tag 100 as described above with reference to FIG. 1) of the security tag includes a wedge member 1002 movable by an SMA wire 1003 in plane that intersects the first axis 209 of the connecting member 104 to move opposing jaw members 1006 and 1008 away from the first axis 209 and allow detachment of the connecting member 104 from the security tag body 102. The split wedge jaws implementation 1000 includes the connecting member 104 having the pin portion 208 (similar to the pin portion as described above with reference to FIG. 2) extending along the first axis 209 (vertical as shown in FIG. 10). The locking member 106 of the split wedge jaws implementation 1000 includes the SMA wire 1003 (similar in physical properties to the SMA wire 202 as described above in FIG. 2) configured to move the wedge member 1002 and the jaw members 1006 and 1008. The SMA wire 1003 may be wrapped around a fulcrum member 1004 that extends from a wedge member 1002 to connect to and control movement of the wedge member 1002. The ends of the SMA wire 1003 are fixedly connected to the tag body member 102 and/or mounts on one or more components fixed to the tag body member 102. The first jaw member 1006 and the second jaw member 1008 are rotatably connected to the tag body member 102 and include respective edges 1010 and 1011 to releasably hold the pin portion 208. The first jaw member 1006 and the second jaw member 1008 together form a jaw mechanism movable in a plane that intersects the first axis 209 between a first position in contact with the pin portion 208 and corresponding to the locked position of the locking member 106 and a second position corresponding to the unlocked position of the locking member 106. The wedge member 1002 is movable into contact with the jaw mechanism based on contraction of the SMA wire 1003. The first jaw member 1006 and the second jaw member 1008 can move outwardly from one another in the same plane along angled guides (angled guides not shown in FIGS. 10-13 for simplification) when the wedge member 1002 is driven by the SMA wire 1003 in the direction of the pin portion 208. The respective opposing edges 1010 and 1011 of the first jaw member 1006 and the second jaw member 1008 form an opening 1050 to receive and releasably hold the pin portion 208 of the connecting member 104.

The locking member 106 may further include respective biasing members 112 with respective first ends connected to the first jaw member 1006 and the second jaw member 1008, and respective second ends connected to one or more respective fixed components or mounts on the tag body member 102 (not shown in FIG. 10 for simplification) to provide a biasing force to bias the jaw members 1006 and 1008 into the locked position. In particular, the respective biasing members 112 provide a biasing force along a second axis normal to and in a direction of the first axis 209, to bias the jaw mechanism into the locked position of the locking member 106.

In the locked state (FIGS. 10 and 11), the SMA wire 1003 is in a first thermal state and may be configured to not apply force to the wedge member 1002 or to apply a force less than sufficient to move the jaws mechanism out of the first position in contact with the pin portion 208 and corresponding to the locked position of the locking member 106. The SMA wire 1003 is configured to move the wedge member 1002 to slidingly force the jaw mechanism into the second position when the SMA wire 1003 transitions from the first thermal state to the second thermal state (as described below in FIGS. 12 and 13).

Figure 13:
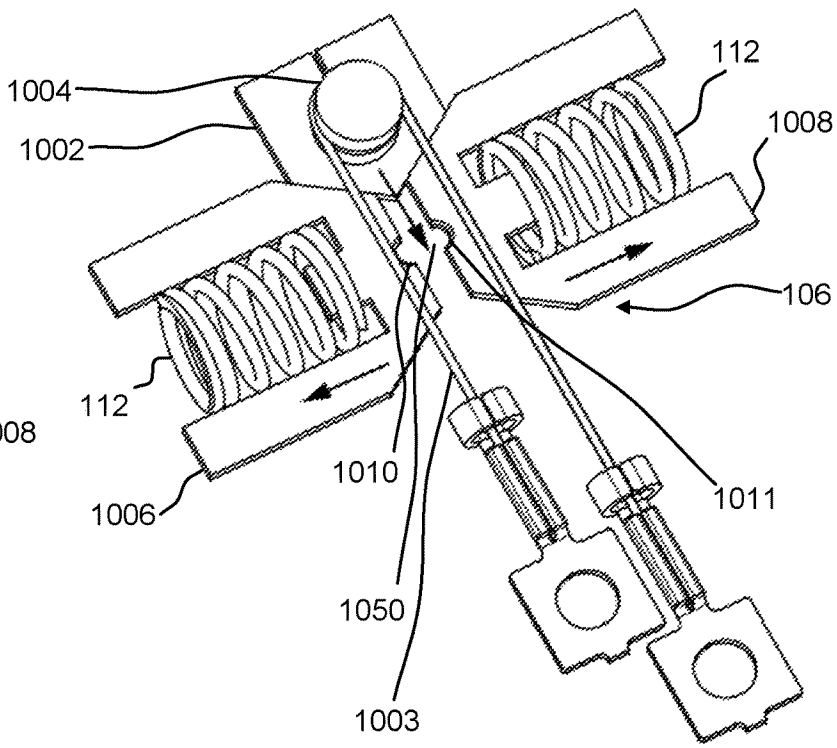
FIG. 13 is a top perspective view of the split wedge jaws components of FIG. 12, with the arrows indicating a direction of movement of the components.
Figure 12:
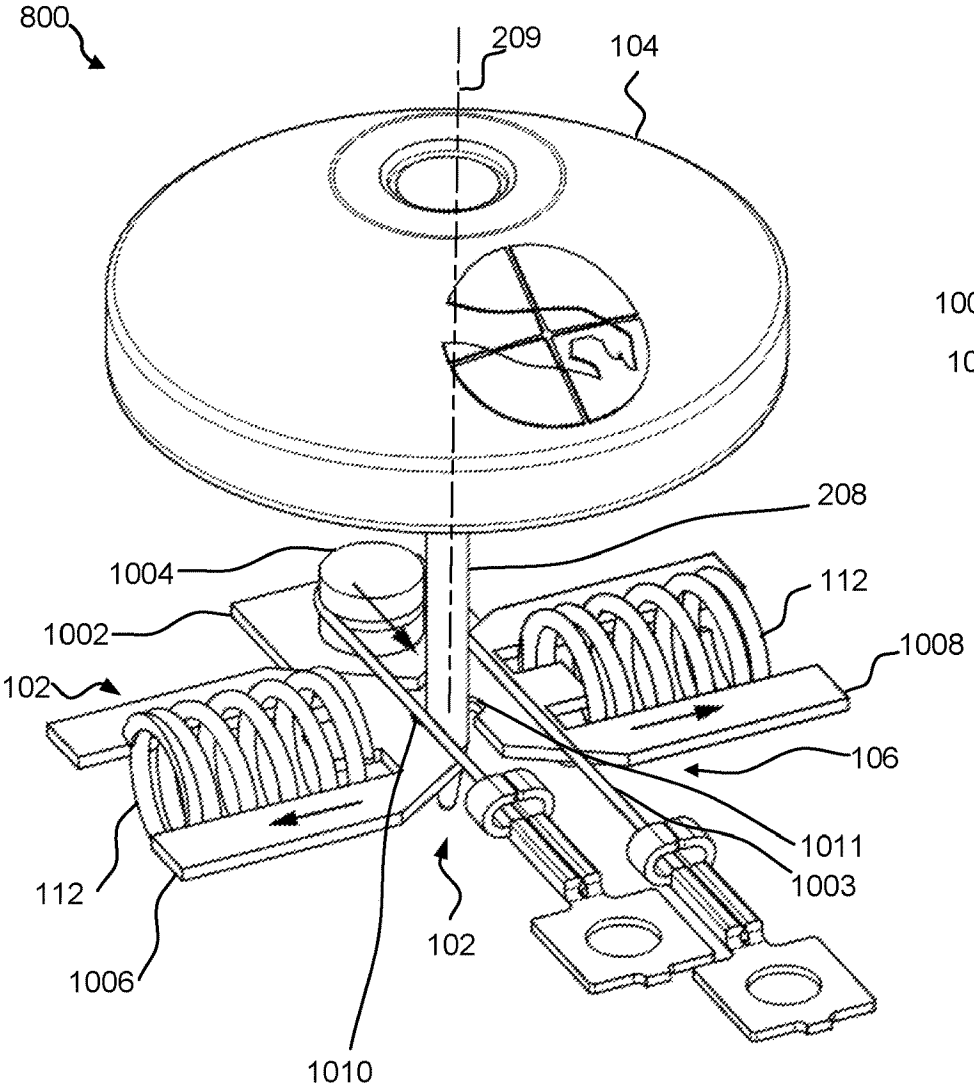
FIG. 12 is a front perspective view, with the security tag body removed, of the split wedge jaws implementation of the security tag of FIG. 10 in an unlocked state.

Referring specifically to FIGS. 12 and 13, an unlocking of the split wedge jaws implementation 1000 of the security tag may occur, for example, upon receiving an instruction from the interrogator (as described above), the energy harvesting device 213 (FIG. 2) on the security tag may release energy to the SMA wire 1003 and cause the SMA wire 1003 to transition from the first thermal state to the second thermal state. In one implementation, the tag body member 102 may include the circuit 215 (FIG. 2) in electrical communication with the SMA wire 1003. The circuit 215 may provide an electrical signal to the SMA wire 1003, in response to a release command (e.g., the instruction received from the interrogator), to trigger transition of the SMA wire 1003 from the first thermal state to the second thermal state. For example, the electrical signal may heat the SMA wire 1003 causing the SMA wire 1003 to contract, and the SMA wire 1003 on contraction can move the jaw mechanism to the second position. For example, the SMA wire 1003 may move the wedge member 1002 within a plane along the second axis and in a direction opposite towards the pin portion 208 (as indicated along the direction of the arrow pointing towards the opening 1050 in FIG. 13). The wedge member 1002 may drive the first jaw member 1006 and the second jaw member 1008 apart, i.e., in the second position of the jaws mechanism. The second position of the jaw mechanism may correspond to the unlocked position of the locking member 106. The movement of the first jaw member 1006 and the second jaw member 1008 may be in the same plane along the second axis and in a direction away from the first axis 209 (as shown by arrows on the first jaw member 1006 and the second jaw member 1008, respectively). The movement of the jaw mechanism from the first position to the second position causes a release of the pin portion 208 from the jaw members 1006 and 1008, resulting in the unlocked state of the security tag.

The drawing figures depict various and different implementations of the security tag, however the security tag of the present application is not limited to the above described implementations and precise arrangements shown in the figures. Based on a locking arrangement of the security tag, a shape memory alloy element of a locking member of the security tag may take the form of any number of geometries as advantageous for a given security tag and locking mechanism. Further, the shape memory alloy element may be configured to maximize a retracting force resulting from the energization of the shape memory alloy element.

Other embodiments of the present invention can include, but are in no way limited to one or more clamps formed form a SMA, where the resulting change in shape of SMA may be caused by an electric current or heat causing the clamp(s) to release a pin portion; a spring made from an SMA material that retracts a three-ball clutch by itself; a long lever arm activated by an SMA wire that retracts a 3-ball clutch system releasing a pin portion; a single clamp or wedge formed from an SMA, such that the single clamp or wedge is lifted away from a pin portion to release the pin portion; and a pin portion shaft formed from an SMA, where the change in shape of the pin portion shaft causes the pin portion to release itself from a fixed clamp in the security tag, without any mechanical manipulation of the clamp.

The invention claimed is:

1. A security tag, comprising:

a tag body member;

a connecting member releasably engageable with the tag body member; and a locking member having a locked position in a first thermal state configured to lock the connecting member to the tag body member, and having an unlocked position in a second thermal state configured to unlock the connecting member from the tag body member;

wherein the connecting member includes a pin portion extending along a first axis; and wherein the locking member includes:

a clamping member movable along a second axis normal to the first axis between a first position in contact with the pin portion and corresponding to the locked position and a second position corresponding to the unlocked position; and a shape memory alloy element extending between a first end and a second end along the second axis and connected to the clamping member, wherein the shape memory alloy element is configured to change length along the second axis and move the clamping member to the second position to release the pin portion in response to the shape memory alloy element transitioning from the first thermal state to the second thermal state.

2. The security tag of claim 1, further comprising a security device mounted in the tag body and configured to transmit a security device signal in response to receiving an interrogation signal, wherein the security device signal includes identification information.

3. The security tag of claim 1, wherein the locking member includes a locking body comprising the shape memory alloy.

4. The security tag of claim 1, wherein the locking member includes the clamping member connected to the shape memory alloy element, wherein a transition of the shape memory alloy element from the first thermal state to the second thermal state is configured to move the clamping member from the locked position to the unlocked position.

5. The security tag of claim 4, wherein the clamping member is configured to engage the pin portion in the locked position.

6. The security tag of claim 1, further comprising a biasing member in contact with the locking member and having a biasing force configured to bias the locking member toward the locked position.

7. The security tag of claim 1, further comprising:

an energy harvesting device configured to releasably store energy;

a circuit electrically connecting the energy harvesting device with the locking member; and wherein the locking member includes the shape memory alloy element connected to the circuit, wherein a release of the energy from the energy harvesting device is configured to cause the shape memory alloy element to transition from the first thermal state to the second thermal state and to move the locking member from the locked position to the unlocked position.

8. The security tag of claim 1, further comprising a biasing member in contact with the clamping member and having a biasing force along the second axis in a direction toward the pin portion to bias the clamping member into the locked position.

9. The security tag of claim 1, wherein the shape memory alloy is configured to transition from the first thermal state to the second thermal state in response to an increase in temperature, wherein a second length of the shape memory alloy in the second thermal state is smaller than a first length of the shape memory alloy in the first thermal state.

10. The security tag of claim 1, further comprising a circuit in electrical communication with the shape memory alloy element, wherein the circuit is configured to provide an electrical signal to the shape memory alloy element, in response to a release command, to trigger movement of the shape memory alloy element from the first thermal state to the second thermal state.

11. The security tag of claim 10, further comprising, the circuit configured to transmit the electrical signal, in response to the release command, to the shape memory alloy element to heat the shape memory alloy element, and contract the shape memory alloy element to move the clamping member to the second position.

12. A security tag, comprising:

a tag body member;

a connecting member releasably engageable with the tag body member;

a locking member, having a locked position in a first thermal state configured to lock the connecting member to the tag body member, and having an unlocked position in a second thermal state configured to unlock the connecting member from the tag body member;

wherein the connecting member includes a pin portion extending along a first axis; and wherein the locking member includes:

a clutch mechanism having a containing member movable along a second axis parallel to the first axis between a first position in contact with the pin portion and corresponding to the locked position and a second position corresponding to the unlocked position; and a plurality of shape memory alloy elements longitudinally extending between a first end and a second end parallel to the first axis, wherein each first end is connected to the containing member of the clutch mechanism at a spaced apart position and configured to evenly apply force to the containing member to move the clutch mechanism to the second position to release the pin portion in response to the shape memory alloy element transitioning from the first thermal state to the second thermal state.

13. The security tag of claim 12, further comprising a biasing member in contact with the clutch mechanism and having a biasing force in a direction along the second axis to bias the clutch mechanism into the locked position.

14. The security tag of claim 13, wherein the biasing member is defined by the shape memory alloy element having a helical shape.

15. The security tag of claim 12, wherein the shape memory alloy elements comprise one or more shape memory alloy wires, a first end of each of the shape memory alloy wires connected to the clutch mechanism and a second end of each of the shape memory alloy wires connected to the tag body.

16. The security tag of claim 12, further comprising a circuit in electrical communication with the shape memory alloy element, wherein the circuit is configured to provide an electrical signal to the shape memory alloy element, in response to a release command, to trigger movement of the shape memory alloy element from the first thermal state to the second thermal state.

17. A security tag, comprising:

a tag body member;

a connecting member releasably engageable with the tag body member;

a locking member, having a locked position in a first thermal state configured to lock the connecting member to the tag body member, and having an unlocked position in a second thermal state configured to unlock the connecting member from the tag body member;

wherein the connecting member includes a pin portion extending along a first axis; and wherein the locking member includes:

a jaw mechanism, including a first jaw member and a second jaw member each rotatably connected to the tag body, movable in a plane that intersects the first axis between a first position in contact with the pin portion and corresponding to the locked position and a second position corresponding to the unlocked position; and a shape memory alloy element connected to the jaw mechanism and configured to move the jaw mechanism within the plane to the second position to release the pin portion in response to the shape memory alloy element transitioning from the first thermal state to the second thermal state, the shape memory alloy element including a longitudinal body in contact with a fulcrum member, the fulcrum member extending from the tag body, between a first end connected to the first jaw member and a second end connected to the second jaw member.

18. The security tag of claim 17, further comprising a biasing member in contact with the jaw mechanism and having a biasing force in a direction toward the jaw mechanism to bias the jaw mechanism into the locked position.

19. The security tag of claim 17, further comprising a circuit in electrical communication with the tag body member shape memory alloy element, and wherein the circuit is configured to provide an electrical signal to the shape memory alloy element, in response to a release command, to trigger movement of the shape memory alloy element from the first thermal state to the second thermal state.

20. A security taq, comprising:

a tag body member;

a connecting member releasably engageable with the tag body member;

a locking member having a locked position in a first thermal state configured to lock the connecting member to the tag body member, and having an unlocked position in a second thermal state configured to unlock the connecting member from the tag body member;

wherein the connecting member includes a pin portion extending along a first axis; and wherein the locking member includes:

a jaw mechanism movable in a plane that intersects the first axis between a first position in contact with the pin portion and corresponding to the locked position and a second position corresponding to the unlocked position;

a wedge member movable into contact with the jaw mechanism; and a shape memory alloy element connected to the wedge member and configured to move the wedge member to slidingly force the jaw mechanism into the second position in response to the shape memory alloy element transitioning from the first thermal state to the second thermal state.

21. The security tag of claim 20, further comprising:

a fulcrum member extending from the wedge member;

wherein the jaw mechanism includes a first jaw member and a second jaw member each rotatably connected to the tag body; and wherein the shape memory alloy element includes a longitudinal body in contact with the fulcrum member between a first end connected to the first jaw member and a second end connected to the second jaw member.

22. The security tag of claim 20, further comprising a biasing member in contact with the jaw mechanism and having a biasing force in a direction toward the jaw mechanism to bias the jaw mechanism into the locked position.

23. The security tag of claim 20, further comprising a circuit in electrical communication with the shape memory alloy element, and wherein the circuit is configured to provide an electrical signal to the shape memory alloy element, in response to a release command, to trigger movement of the shape memory alloy element from the first thermal state to the second thermal state.

24. A method for releasing a security tag from an article, the security tag including a tag body member and a connecting member with a pin portion extending along a first axis, the tag body member including an opening for receiving and holding the pin portion in a locking arrangement, comprising:

disposing a locking member disposed in the tag body member, the locking member including at least a clamping member movable along a second axis normal to the first axis between a first position in contact with the pin portion and corresponding to a locked position and a second position corresponding to an unlocked position and a shape memory alloy (SMA) element extending between a first end and a second end along the second axis and connected to the clamping member, wherein the SMA element is configured to change length along the second axis and move the clamping member to the second position to release the pin portion in response to the SMA element transitioning from a thermal state to a second thermal state, attaching at least one segment of the (SMA) element to a portion of the locking member such that the SMA element is operatively associated with the at least one clamp, and positioning and configuring the SMA element within the tag body such that heat-induced shrinkage of the SMA element serves to mechanically urge the clamp to an unlocked, pin-releasing position.

25. The method of claim 24, further comprising:

heating the SMA element by application of an electrical current until the SMA element retracts to a smaller size relative to an unheated size of the SMA element, a reduction in size of the SMA element causing the at least one clamp to be moved to an unlocking position by a mechanical linkage between the at least one clamp and the SMA element whereby the pin portion is released from the clamp; and withdrawing the pin portion from the tag body member to release an article secured between the pin portion and the tag body member.

26. The method of claim 24, further comprising:

inducing an electrical current in one or more elements in the tag body member using an applied field;

harvesting energy produced by the induced current; and storing the harvested energy in an energy storage module disposed in the tag body member.

27. The method of claim 26, further comprising:

providing an electronic trigger signal to selectively release energy stored in the energy storage module at such time when the release of the pin portion from the at least one clamp is desired.

* * * * *